US006493929B2

(12) United States Patent
Holland et al.

(10) Patent No.: US 6,493,929 B2
(45) Date of Patent: Dec. 17, 2002

(54) GUIDE TOOL FOR COUPLING AN END CONNECTOR TO A COAXIAL CABLE

(76) Inventors: Michael Holland, 4219 Transport St., Ventura, CA (US) 93003; Chi-Fu Chang, No. 16, Alley 10, Lane 187, Sec. 1, Li-Nung St., Peito District, Taipei (TW)

( * ) Notice: Subject to any disclaimer, the term of this patent is extended or adjusted under 35 U.S.C. 154(b) by 42 days.

(21) Appl. No.: 09/851,115

(22) Filed: May 9, 2001

(65) Prior Publication Data

US 2002/0166227 A1 Nov. 14, 2002

(51) Int. Cl.[7] ..... H01R 43/042

(52) U.S. Cl. ..... 29/750; 29/280

(58) Field of Search ..... 29/278, 280, 281, 29/747, 748, 750, 857

(56) References Cited

U.S. PATENT DOCUMENTS

| | | | | |
|---|---|---|---|---|
| 1,720,318 A | * | 7/1929 | Chisholm | 29/278 X |
| 2,960,864 A | * | 11/1960 | Watts | 29/747 X |
| 3,222,766 A | * | 12/1965 | Camargo | 29/278 X |
| 5,392,508 A | * | 2/1995 | Holliday et al. | 29/280 X |

* cited by examiner

*Primary Examiner*—Robert M. Fetsuga
(74) *Attorney, Agent, or Firm*—Troxell Law Office PLLC

(57) ABSTRACT

The present invention relates to a guide tool, the said guide tool is capable of assisting one end of a coaxial cable to be coupled to an end connector; it comprises of a body installed with a guide mechanism therein, the said guide mechanism possesses a guide tube for guiding the cable central conductors of different regulations; the said guide tube can move along the direction of the axle line by the elastic element for rapidly and precisely inserting the central conductor and the dielectric into the columnar member of the end connector and further becomes the best auxiliary tool.

6 Claims, 6 Drawing Sheets

GUIDE TOOL FOR COUPLING AN END CONNECTOR TO A COAXIAL CABLE

BACKGROUND OF THE INVENTION

1) Field of the Invention

The present invention relates to a guide tool, more especially, an auxiliary tool provides for guiding the central conductor of a coaxial cable to an end connector thereby rapidly and precisely guiding the central conductor into the end connector to form coupling, the said guide tool can be carried around by the working personnel for continuous and repeated usage.

2) Description of the Prior Art

In cable television systems (CATV), subscription television systems (STV), and master antenna television systems (MATV), terminal, and other systems, the signals are transmitted by means of coaxial cable. Referring to FIG. 1, the conventional coaxial cable connector of such systems is comprised of the coaxial cable 10 itself and an end connector 11; the installation personnel must effectively insert the cable 10 into the end connector 11 such that the center conductor 12 and the dielectric 13 are inserted through the inside of a hollow body 14 of the end connector 11, while the braided conductor 15 and the outer jacket 16 are sleeved around the extended rear section 17 of the hollow body 14 and, finally, a ring 18 is crimped over the coaxial cable 10 to bind it firmly to the extended rear section 17; however, since the inner diameter of the said hollow body 14 is slightly larger that the outer diameter of the dielectric 13, the installation personnel have an extremely difficult time inserting the dielectric 13 into the hollow body 14; furthermore, if the center conductor 12 is in a state of disarray, the installation personnel experience further difficulty while inserting the dielectric 13 through the hollow body 14, which poses tremendous installation problems; as such, the industry is currently awaiting a solution to the said shortcomings to increase competitiveness.

In view of the said situation, the inventor of the inventor herein conducted intensive research based on many years of experience accumulated while engaged in the production and marketing of related products which, following continuous testing and refinements, finally culminated in the development the guide tube of invention herein.

SUMMARY OF THE INVENTION

Therefore, the primary objective of the present invention is to provide a guide tool, the said guide tool can be inserted into an end connector thereby enabling the central conductor of a coaxial cable guided by the guide tool to precisely and rapidly couple the end connector.

To enable a further understanding of the features and technical contents of the present invention, the brief description of the drawings below is followed by the detailed description of the preferred embodiment; however, the attached illustrations are provided only for reference and elaboration and should not be construed as any limitation whatsoever of the present invention.

DETAILED DESCRIPTION OF THE PREFERRED EMBODIMENTS

Figure 1:
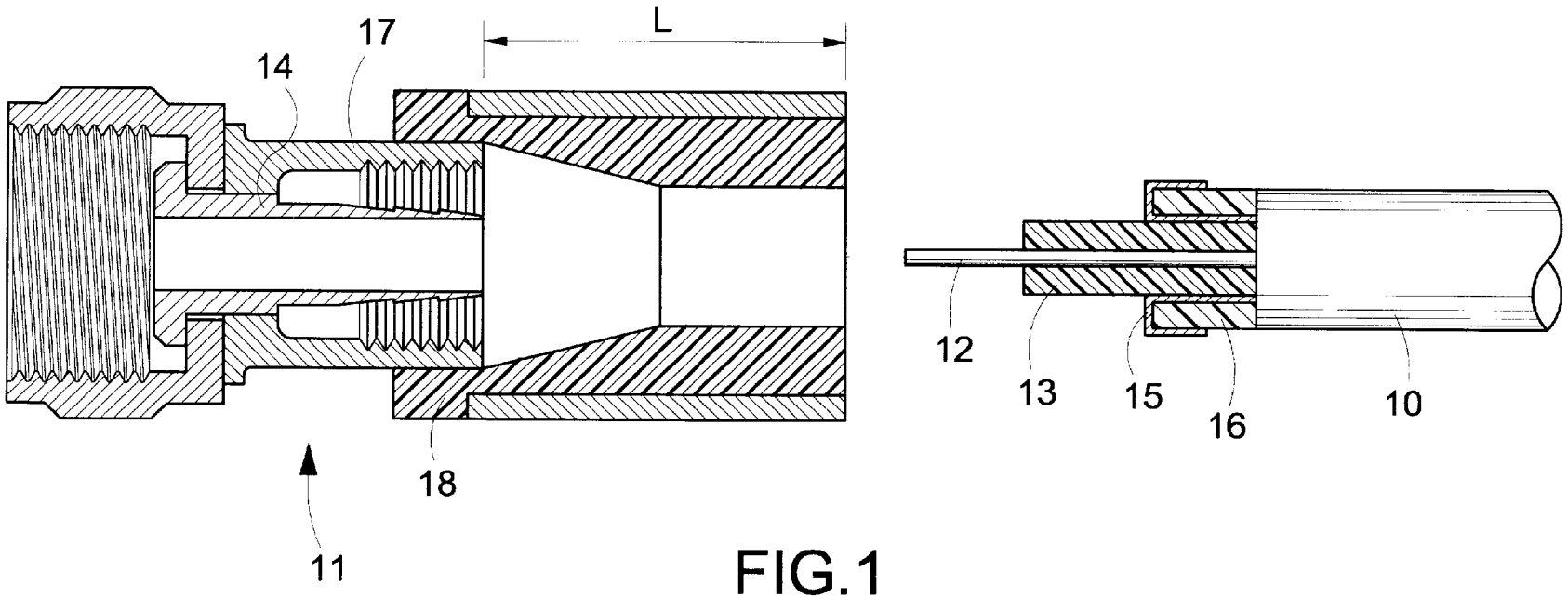
FIG.1 PRIOR ART
FIG. 1 is a cross-sectional drawing of an unassembled conventional end connector and a coaxial cable.
Figure 2:
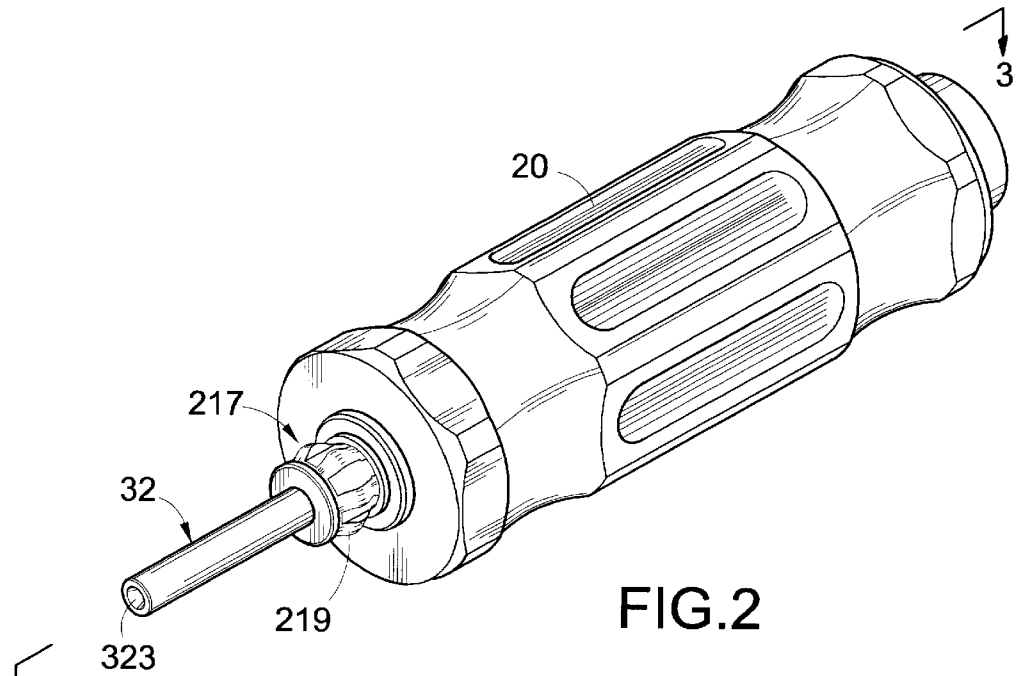
FIG. 2 a pictorial view drawing of the guide tool of the present invention.
Figure 3:
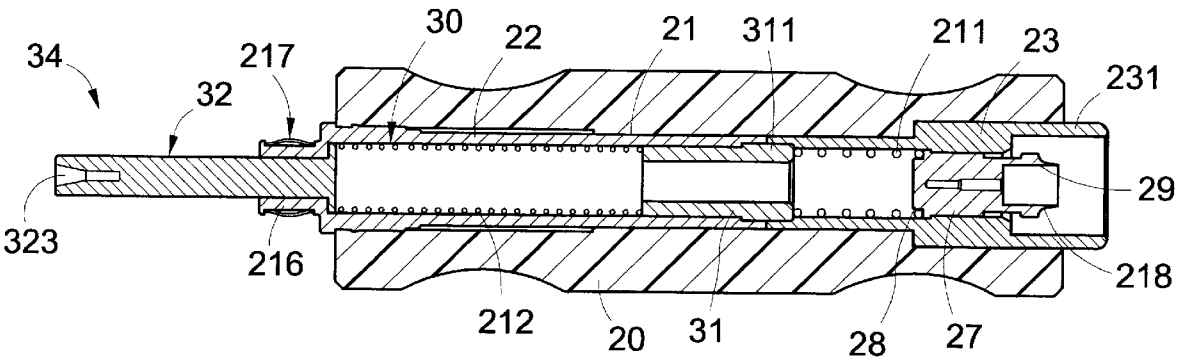
FIG. 3 is a cross-sectional drawing of the present invention taken along line 3—3 of FIG. 2.
Figure 4:
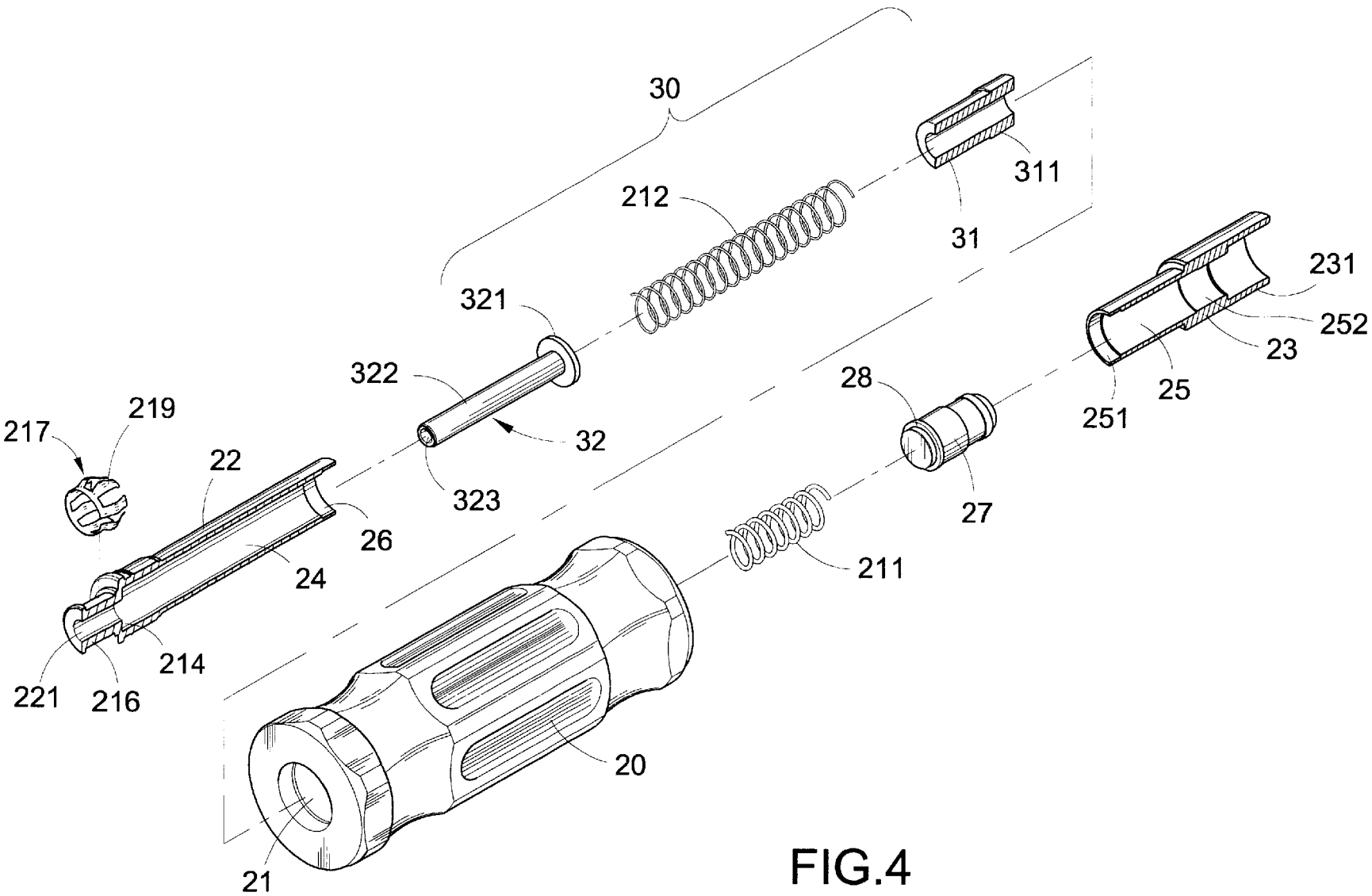
FIG. 4 is a pictorial exploded drawing of the guide tool of the present invention.

Referring to FIGS. 2 to 4, the guide tool of the present invention coupling the coaxial cable to the end connector comprises a body (20) with a hollow cavity (21) formed therein for receiving a first cylindrical outer sleeve (22) and second cylindrical outer sleeve (23); inside the first sleeve (22), a cavity (24) is disposed with its inner portion stops at an annular flat bottom (214), a stop ring groove (26) is formed at the dead end of the cavity (24); a coupling joint (216) is formed at the distal end of the first outer sleeve (22), a through cavity (221) is mounted inside the coupling joint (216) and communicated with the cavity (24); a cavity (25) is disposed inside the second outer sleeve (23) and communicated with the cavity (24) of the first outer sleeve (22); a stop ring groove (251) is formed at the dead end on one side of the cavity (25); a convex ring groove (252) is formed at the dead end on the other side of the cavity (25); a axle collar (231) is formed at the dead end of the second outer sleeve (23).

A supporting tube body (27) is coaxially disposed inside the ring groove (252) of the second outer sleeve (23) and capable of sliding in the cavity (25) along the direction of the axle line; the supporting tube body (27) is manufactured to have a tubular end portion (28) and a insert opening (29); a spring element (211) is encircled on the tubular end portion (28) providing the supporting tube body (27) with recoiling force; a positioning ring portion is formed between the tubular end portion (28) and the supporting tube body (27) for preventing the supporting tube body (27) from sliding out of the ring groove (252) after recoiling; the first outer sleeve (22) and the second outer sleeve (23) are coaxially disposed with a guide mechanism (30) therein.

The guide mechanism (30) comprises a sleeve (31) and a guide tube (32); the flange portion (311) of the sleeve (31) is situated and fixed on the stop ring grooves (26, 251) of the first outer sleeve (22) and the second outer sleeve (23); the end wall of the flange portion (311) presses against one end of the spring element (211); a spring element (212) is disposed between the sleeve (31) and the guide tube (32) to enable the guide tube (32) to move closer toward or away from the sleeve (31) along the direction of the axle line.

The guide tube (32) is manufactured to have a flange end portion (321) and a tubular portion (322); the tubular portion (322) penetrates outward from the through hole (221) of the coupling joint (216) to make the flange end portion (321) press against the annular flat bottom (214) for preventing the guide tube (32) from sliding out of the first outer sleeve (22); the end wall of the flange end portion (321) is pressed by one end of the spring element (212); a hollow cavity (323) is formed at the inner dead end of the guide tube (32) for receiving the central conductor of the coaxial cable.

Figure 5A:
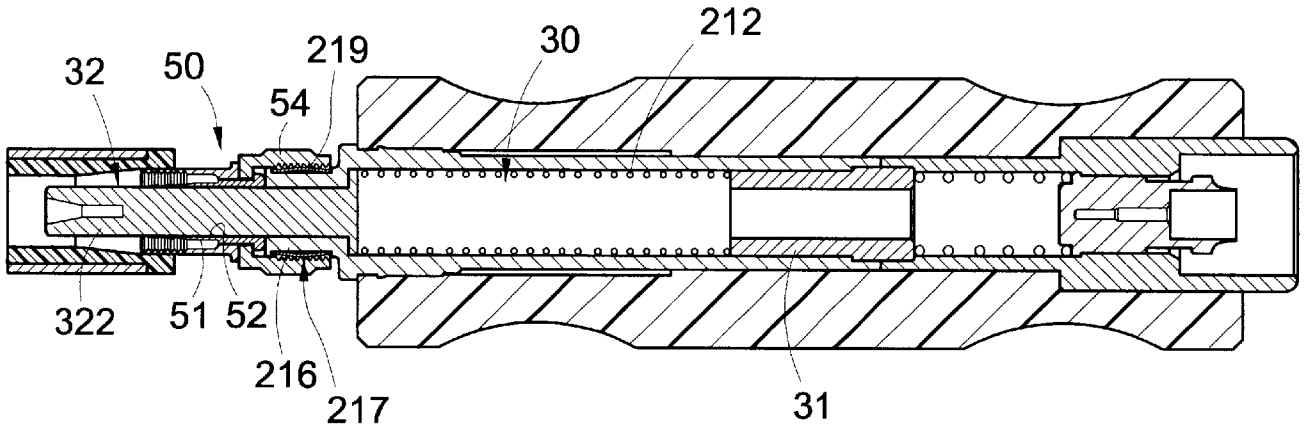
FIGS. 5A to 5C are the stage drawings of the present invention guiding the coaxial cable into the end connector.

The mentioned coupling joint (216) is formed at the distal end of the first outer sleeve (22); an annular clamping piece (217) is installed on the outer portion of the coupling joint (216), several elastic fingers (219) are formed on the annular clamping piece (217), referring also to FIG. 5A, the elasticity of the elastic fingers (219) enables the connector body (54) of the end connector (50) to be fixedly engaged into or pulled out the coupling joint (216).

Figure 5B:
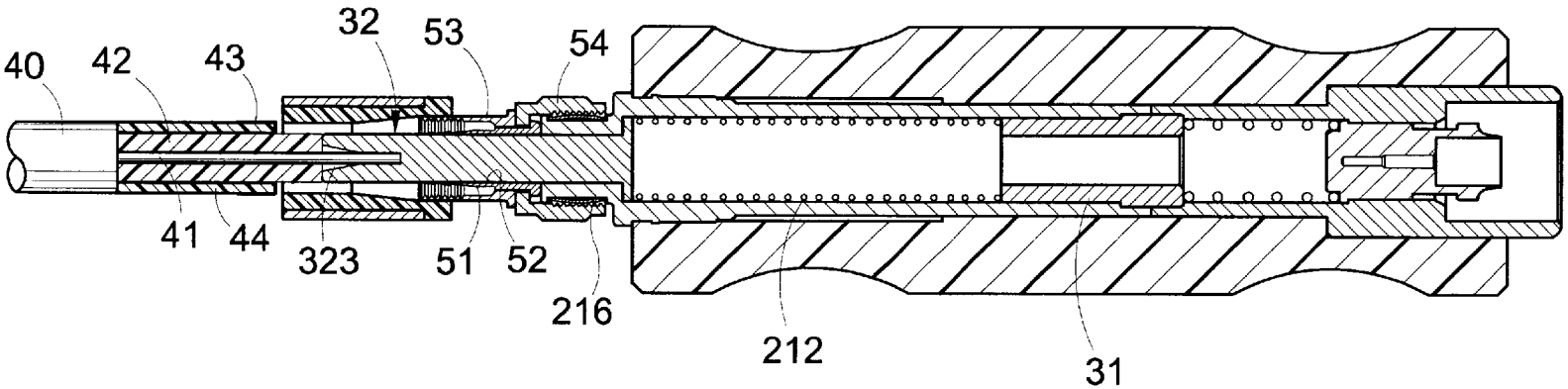
Figure 5C:
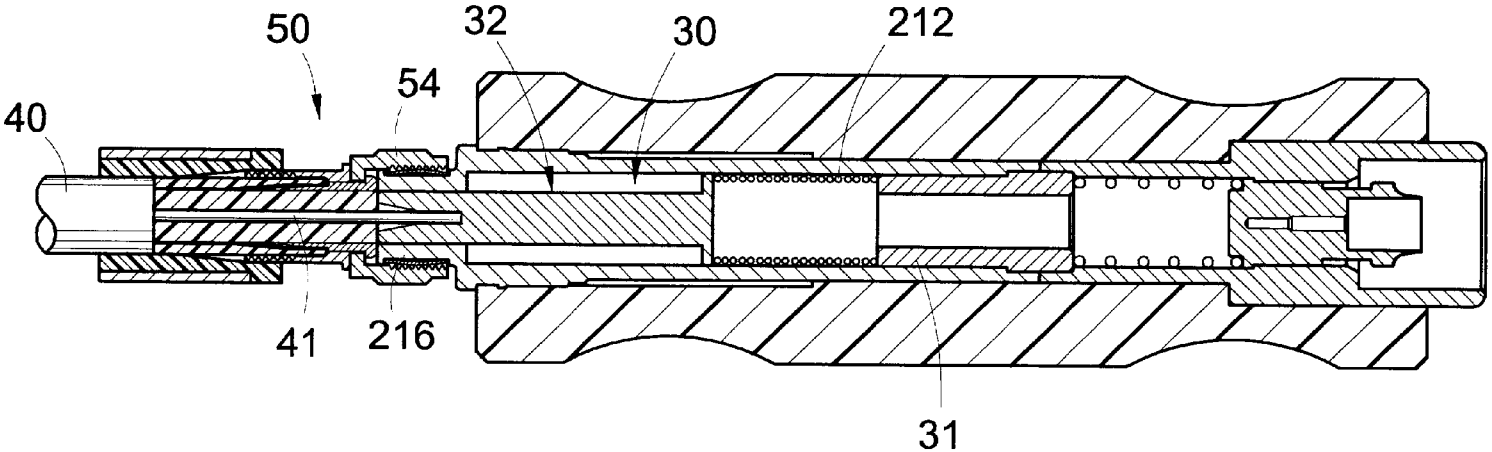

The present invention can be adapted to different kinds of coaxial cable regulations, such as RG6 (with 4.8 mm dielectric diameter), RG7 (with 6.0 mm dielectric diameter), RG59 (with 3.8 mm dielectric diameter). FIGS. 5A to 5C indicate the relative position and relationship occurred in the guide mechanism (30) while the guide tube (32) guides coaxial cable RG59 (40) to the end connector (50); first, the guide tube (32) of the guide tool is inserted from one end of the end connector (50) until the tubular portion (322) protrudes outside of the drill hole (52) of the columnar member (51) and enables the inner portion of the connector body (54) to be sleeved on the outer portion of the clamping piece (217) to form coupling (as shown in FIG. 5A); for the second step, the central conductor (41) of the coaxial cable (40) is inserted into the hollow cavity (323) of the guide tube (32) (as shown in FIG. 5B), push force is exerted onto the coaxial cable (40) thereby enabling the guide tube (32) to move along the direction of the axle line, while the central conductor (41) follows the movement of the guide tube (32) to make the dielectric (42) of the cable (40) enter the drill hole (52) of the columnar member (51), and the braided conductor (43) and the outer jacket (44) of the cable (40) are thereby positioned between the columnar member (5 ) and the compressing sleeve (53); when being compressed by push force, the guide tube (32) moves closer toward the sleeve (31) along the direction of the axle line, in the mean time, the spring element (212) is in a compressed state (as shown in FIG. 5C), thereby the coaxial cable (40) can be rapidly and precisely coupled onto the end connector (50); when finishing the mentioned action, the guide tool is then pulled out, and the guide tube (32) resumes back to the original starting position by means of the spring element (212). After accomplishing the assembly of inserting the coaxial cable (40) into the end connector (50), the outer jacket (44) of the cable (40) can be pressed into closure onto the end connector (50) for coupling by means of a conventional compressing tool.

Figure 6:
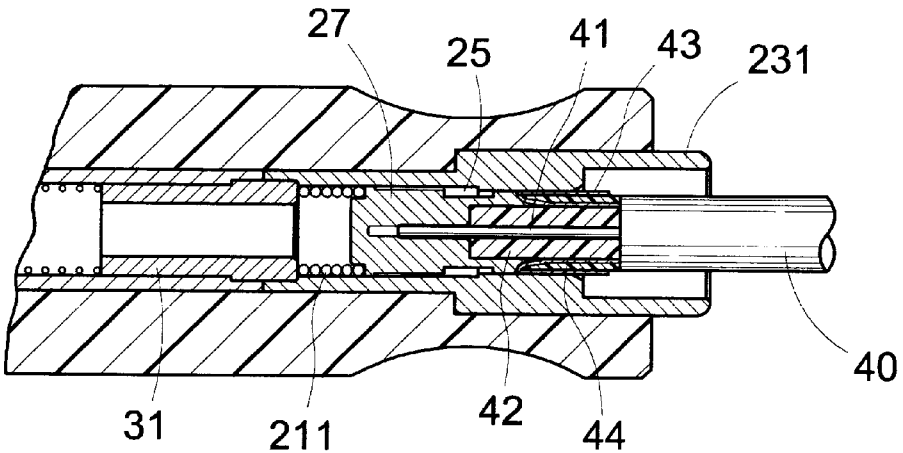
FIG. 6 is a cross-sectional drawing of the braided conductor spreading outward and covering on the external surface of the cable outer jacket.

As indicated in FIGS. 3 and 6, a knife arcuate plane (218) is formed at the distal end of the supporting tube body (27) and on the external surface of the insert opening (29); therefore, after the central conductor (41) and the dielectric (42) of the coaxial cable (40) are inserted into the insert opening (29), the braided conductor (43) is positioned on the knife arcuate plane (218), and push force is exerted onto the coaxial cable (40) to enable the supporting tube body (27) to move closer toward the sleeve (31) along the direction of the axle line (at this time, the spring element (211) is in a compressed state); the movement of the supporting tube body (27) makes the braided conductor (43) enter the cavity (25) of the second outer sleeve (23) thereby makes the braided conductor (43) cover over the external surface of the cable outer jacket (44) for preventing the working personnel from piercing the fingers unintentionally due to manually spreading out the braided conductor (43); after accomplishing the mentioned action, the cable (40) can be pulled out from the insert opening (29) and the supporting tube body (27) can resumes back to the original starting position by means of the spring element (211).

Figure 7A:
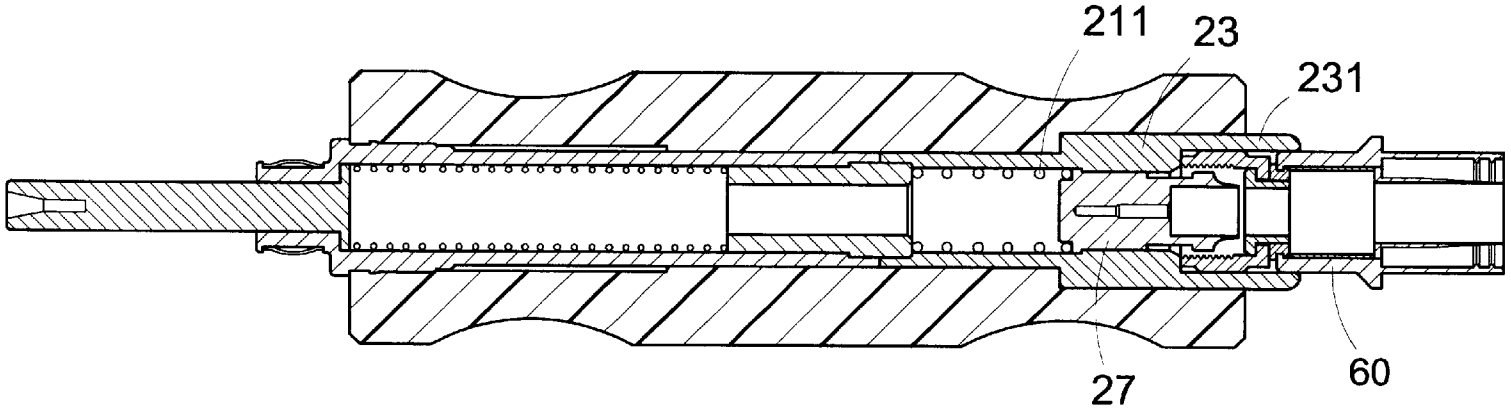
FIGS. 7A and 7B are drawings showing the axle collar of the second outer sleeve provided for the placement of the RG11 end connector thereby for inserting the coaxial cable into the end connector to form coupling.
Figure 7B:
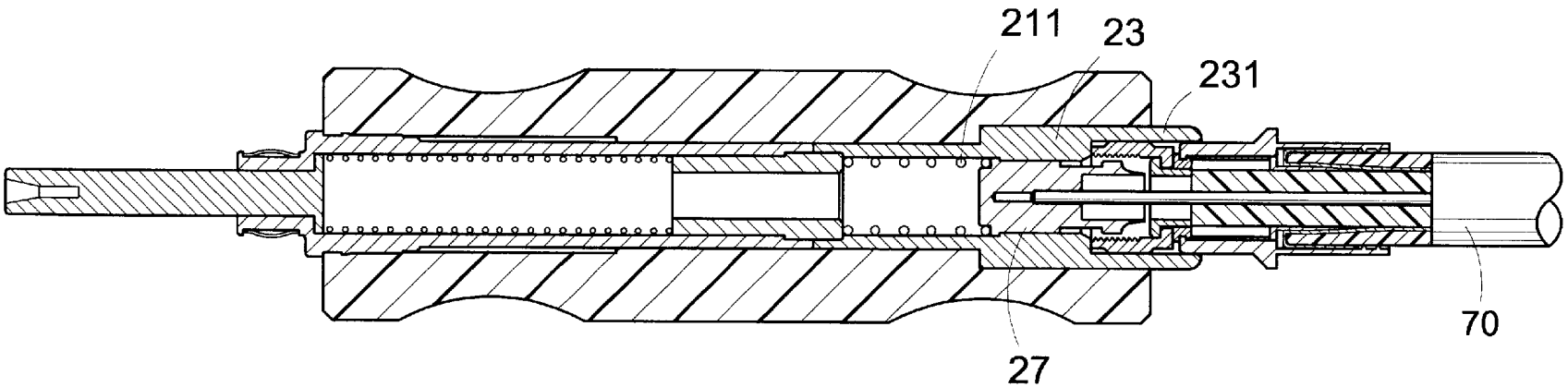

As shown in FIGS. 3, 7A and 7B, an annular axle collar (231) is formed at the distal end of the second outer sleeve (23), the said annular axle collar (231) can fix the end connector (60) of RG11 (with 7.2 mm dielectric diameter), thereby the coaxial cable (70) can be rapidly inserted into the end connector (60), by means of the assistance of the axle collar (231), to form coupling.

To sum up, the guide tool of the present invention is capable of rapidly and precisely coupling one end of the coaxial cable onto the end connector and adapting to the coaxial cables of different regulations. When the central conductor of the coaxial cable is inserted into the guide tube and push-in force is exerted onto the coaxial cable, the central conductor and the dielectric of the coaxial cable can rapidly enter the drill hole of the columnar member and thereby to form coupling.

Although the specific embodiment of the present invention has been illustrated above, it is apparent to those skilled in the art that many variations or modifications to be achieved easily will not separate from the spirit of the present invention. The scope of the claims applied for new patent rights also try to include all the variations or modifications within the spiritual scope of the present invention.

What is claimed is:

1. A guide tool for coupling a coaxial cable to an end connector, the said end connector comprises of a connector body, a compression sleeve and a columnar member coaxially disposed inside the compressing sleeve for coupling the dielectric and the braided conductor of the coaxial cable; the said guide tool consists of:

a body possesses a hollow cavity;

a set of outer sleeve installed inside the hollow cavity of the said body;

a said guide mechanism comprises of a sleeve coaxially disposed inside of the said set of outer sleeve and a guide tube with one end thereof protruding outside the body and situated on the axle line of the sleeve with an axial interval; the said guide tube can receive the central conductor of the coaxial cable; push-in force exerted onto the coaxial cable enables the guide tube to move closer toward the sleeve along the direction of the axle line; through the guiding of the guide tube, the dielectric of the coaxial cable can rapidly and precisely couple the columnar member.

2. As mentioned in claim 1 of the guide tool, wherein, the said guide mechanism utilizes spring device to urge the guide tool to move closer toward or away from the sleeve along the direction of the axle line.

3. As mentioned in claim 1 of the guide tool, wherein, the cavity dead end of the said set of outer sleeves is disposed with a supporting tube body, the said supporting tube body can move closer toward or away from the sleeve and is positioned on the axle line of the sleeve with an axial interval; the said supporting tube body has a insert opening therein for providing the insertion of the central conductor of the coaxial cable and exerts push-in force onto the coaxial cable to enable the braided conductor of the cable to cover over the external surface of the cable outer jacket.

4. As mentioned in claim 3 of the guide tool, wherein, a axle collar is formed at the distal end of the said set of outer sleeves and coaxially disposed outside the insert opening for providing the insertion of the end connector of RG11 into the axle collar; through the assistance of the guide tool, the coaxial cable can be rapidly inserted into the end connector to form coupling.

5. As mentioned in claim 3 of the guide tool, wherein, the said supporting tube body utilizes the spring device to urge the moving closer toward or away from the sleeve along the direction of the axle line.

6. As mentioned in claim 1 of the guide tool, wherein, a coupling joint is formed at the distal end of the said set of outer sleeves, the said coupling joint is sleeved by an annular clamping piece thereon, several elastic fingers are disposed on the annular clamping piece for enabling the connector body of the end connector to be fixedly engaged into or pulled out the coupling joint.

* * * * *